US006320306B1

(12) United States Patent
Heine et al.

(10) Patent No.: US 6,320,306 B1
(45) **Date of Patent: *Nov. 20, 2001**

(54) SHADOW MASK WITH POROUS INSULATING LAYER AND HEAVY METAL LAYER

(75) Inventors: Gunter Heine; Bernhard Schonert; Peter Neumann; Ulrich Schulke, all of Berlin (DE)

(73) Assignee: Samsung Display Devices Co., Ltd., Suwon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/230,361

(22) PCT Filed: Jul. 31, 1996

(86) PCT No.: PCT/EP97/04169

§ 371 Date: May 12, 1999

§ 102(e) Date: May 12, 1999

(87) PCT Pub. No.: WO98/06124

PCT Pub. Date: Feb. 12, 1998

(30) Foreign Application Priority Data

Aug. 5, 1996 (DE) ..... 196 32 414

(51) Int. Cl.[7] ..... H01J 29/80; H01J 9/12; H01J 9/236

(52) U.S. Cl. ..... 313/402; 313/407; 313/408; 445/37; 445/47

(58) Field of Search ..... 313/402–408, 313/461, 477 R; 427/126.2, 126.3, 376.5; 445/37, 47

(56) References Cited

U.S. PATENT DOCUMENTS

| | | | | |
|---|---|---|---|---|
| 4,442,376 | * | 4/1984 | Van Der Waal et al. | 313/402 |
| 4,671,776 | * | 6/1987 | Tokita | 445/51 |
| 4,751,424 | * | 6/1988 | Tong | 313/402 |
| 4,784,627 | * | 11/1988 | Van Uden | 445/47 |
| 4,931,689 | * | 6/1990 | Van Uden | 313/402 |
| 5,841,223 | * | 11/1998 | Muramatsu et al. | 313/402 |
| 6,144,147 | * | 11/2000 | Heine et al. | 313/402 |

* cited by examiner

*Primary Examiner*—Michael H. Day
*Assistant Examiner*—Matthew J. Gerike
(74) *Attorney, Agent, or Firm*—Leydig, Voit & Mayer, Ltd.

(57) ABSTRACT

A shadow mask for color picture tubes has a cathode-side surface covered with a heat-insulating layer, an electron reflecting and absorbing layer, and a heat-emitting cover layer. Some of the electrons are reflected while others are absorbed in the cover layer and transformed to heat, but the heat does not act directly on the mask and is emitted into the interior of the tube. Local temperature differences which particularly occur with high contrast pictures and cause partial doming of the perforated mask are reduced.

8 Claims, 2 Drawing Sheets

SHADOW MASK WITH POROUS INSULATING LAYER AND HEAVY METAL LAYER

The invention relates to a shadow mask for color picture tubes.

BACKGROUND OF THE INVENTION

In a color picture tube having a shadow mask, the mask is arranged in direct proximity to the interior surface of the screen. Because the luminescent segments are produced on the interior surface of the screen, the geometry of the shadow mask is required to conform with the pattern of the luminescent segments when the color picture tube is in operation. Maximum impact accuracy of the electron on the luminescent segments is achieved when the aperture geometry of the shadow mask conforms with the distribution of the luminescent segments on the interior surface of the screen at the operating temperature. However, since only a small portion of the emitted electrons pass through holes in the mask and strike the luminescent segments and the majority of the electrons strike the mask directly, the mask is heated up to 80° C. as a result, giving rise to a change in mask geometry which results in doming of the mask (doming effect).

After doming, the aperture geometry of the shadow mask no longer conforms with the pattern of the luminescent segments, giving rise to imprecise electron impact. The color rendering quality of the screen is disturbed.

With high contrast pictures, different areas of the mask will be heated up to different levels, thus giving rise to partial doming of the mask (local doming) which also results in aberrations when the doming exceeds a tolerance.

A variety of attempts have been made to limit or prevent such disadvantageous thermal behavior of the shadow mask. Thus, various measures have been suggested to limit excessive heating of the mask.

U.S. Pat. No. 3,887,828 suggests applying to the metallic perforated mask a porous manganese dioxide layer and a thin layer of metallic aluminum on top thereof. The aluminum layer has contact with the shadow mask at the aperture edges only. It is electrically conducting and has an electron-absorbing property. Top of the aluminum layer is another layer of graphite, nickel oxide, or nickel iron.

The porosity of the manganese oxide layer is said to originate substantially from the individually arranged particles, the layer being sandwiched by the mask and thin aluminum layer. Due to the layer structure, heat generated by electron impact is intended to be kept away from the metallic perforated mask and emitted in the opposite direction.

This solution has various drawbacks. It has shown that keeping the generated heat away from the perforated mask is not feasible since the major part of the heat is not generated within the aluminum layer and the overlying graphite layer, but in the perforated mask. The electron-reflecting, electron-absorbing, and heat-emitting properties of the aluminum layer are too low. The heat-insulating sandwich structure arranged on top of the perforated mask now results in the opposite effect: The heat can be emitted only with difficulty.

DE 3,125,075 C2 describes an electron-reflecting layer directly coating the shadow mask. This layer contains heavy metals, particularly in the form of their carbides, sulfides or oxides. On electron impact, up to 30% of the electrons can be reflected, which means that the shadow mask is less heated. However, the major part of the electron beam still reaches the shadow mask, giving rise to undesirable heat generation therein and thus, general and local doming phenomena of the shadow mask.

U.S. Pat. No. 4,671,776 suggests coating the shadow mask with borate glass. The glass powder is sprayed onto the mask and is subsequently melted. The glass layer adheres very tightly to the backing. In operating conditions, the doming effect is diminished due to some heat-insulation but the major effect is from tensile forces within the mask resulting from the different expansion coefficients of the layer and the metal of the shadow mask. With such a coating, electron-reflecting effects can hardly be observed, so that a major part of the energy of the impacting electron beam still is transferred to the mask, giving rise to disadvantageous doming behavior.

Moreover, rigid fixation of the mask with a stable glass layer does not meet the higher requirements with respect to color picture quality in the multimedia age.

Another means of significantly limiting the undesirable doming phenomena is the use of high quality metal alloys, such as Invar, for the shadow mask, because this alloy has a particularly favorable thermal expansion coefficient. However, this material is highly expensive with respect to costs.

Moreover, since the cost percentage of the shadow mask with respect to the total cost of a color picture tube is already relatively high, the use of special metal alloys would result in a further increase of costs.

SUMMARY OF THE INVENTION

The object of the invention is now to largely avoid said doming of the shadow mask caused by the action of the electron rays, wherein low-cost steel is to be used as mask material.

According to the invention, the cathode-side surface of a perforated mask is provided with a heat-insulating layer, an electron-reflecting and electron-absorbing layer and a heat-emitting cover layer. Thereby, some of the electrons are reflected, while others are absorbed in the cover layer and transformed to heat, with the heat not acting directly on the perforated mask but being emitted into the interior of the tube due to the arrangement of a heat-insulating layer in accordance with the invention. Local temperature differences, which may give rise to partial doming of the perforated mask are also diminished. Such local temperature differences particularly occur with high contrast pictures.

The heat-insulating layer consists of temperature-resistant porous solids embedded in a binder. According to the invention, oxide, sulfide, silicon and/or aluminophosphate materials or material mixtures are provided. Among others, silicic acid, zirconium dioxide and titanium dioxide are suitable as porous oxides. In particular, the porous siliceous materials include the vast group of zeolites. Particularly suitable are the molecular sieves such as the natural molecular sieves chabazite, mordenite, erionite, faujasite, and clinoptilolite, as well as the synthetic zeolites A, X, Y, L, β, and/or those of the ZSM type. There is such a wide variety of zeolite structures that all the types cannot be mentioned here. Surprisingly, it was found that effective heat-insulation of the perforated mask can be achieved even with thin layers coating the mask. Likewise, advantageous effects result when using porous phosphate solids such as the so-called aluminophosphates, silicoaluminophosphates and metal aluminophosphates which can be produced by synthesis and are classified as small, medium, and large pore types.

Other suitable porous solids are intercalated clay minerals, layer phosphates, and silica gel as well as a variety of aluminosilicates.

More specifically, the electron-reflecting, electron-absorbing, and heat-emitting cover layer combined with the heat-insulating layer includes heavy metal compounds; here, particularly advantageous use can be made of bismuth oxide and bismuth sulfide as well as lead oxide and lead sulfide, and tantalum oxide, cerium oxide and barium titanate.

In particular, crystalline and glass-like silicates, phosphates, and borates are provided as a binder for the cover layer and the heat-insulating layer, whereby water glass, and low-melting glass such as solder glass, as well as metal phosphates were found useful. The binders mentioned are remarkable for their high adhesive properties both on the surface of the mask and between the layers, yielding a coating of extraordinary mechanical stability which results in additional dimensional stability of the perforated mask.

Coating of the layers is effected according to known coating procedures such as, for example, spraying the surface of the mask and therefore can be performed at favorable costs.

The heat-insulating layer has a layer thickness between 10 and 50$\mu$m with an average particle size between 1 and 10$\mu$m, while the heavy metal chalcogenide layer has a thickness of from 1.5 to 4.5$\mu$m, as a rule. Underneath the heat-insulating layer, the perforated mask may have a known blackening layer, for example, of $Fe_3O_4$.

The advantages of the invention lie in the remarkable improvement of the doming behavior of iron masks, thereby making it possible in many cases to abandon the use of costly Invar for the masks.

BRIEF DESCRIPTION OF THE DRAWING FIGURES

The invention will now be illustrated in more detail with reference to the figures and several embodiments.

DETAILED DESCRIPTION

Figure 1:
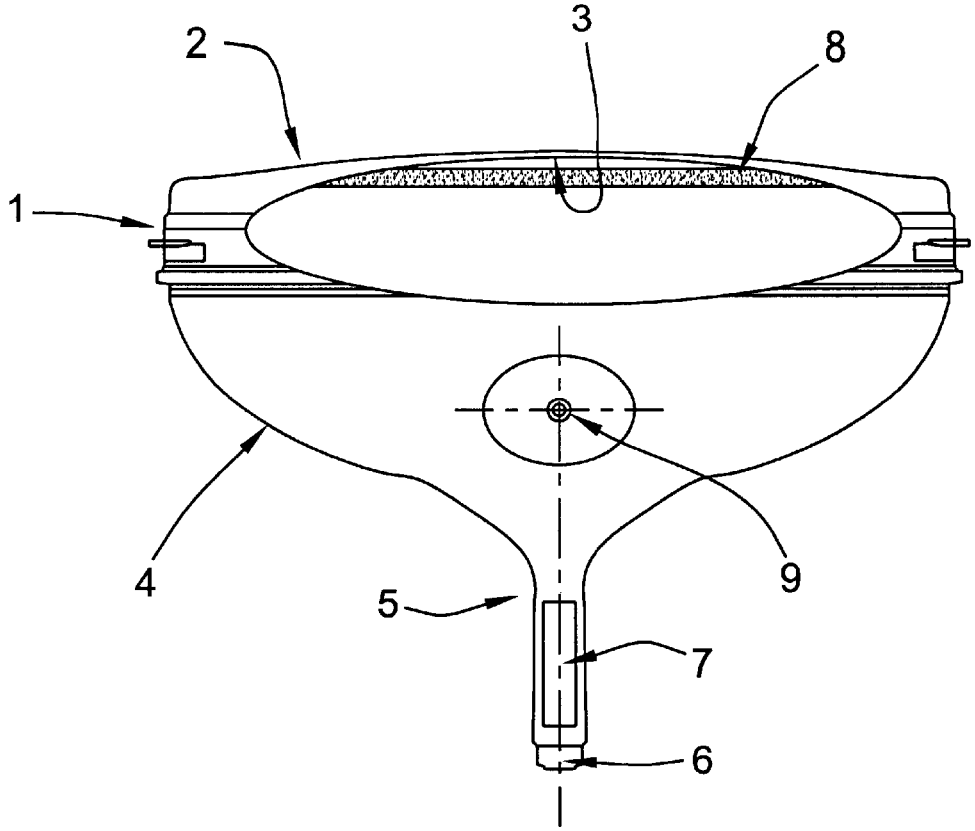
FIG. 1 shows a color picture tube in sectional view.

FIG. 1 shows a color picture tube including a bulb 1 with a screen 2 and a beam system 7 arranged in the tube neck 5 as its main components. The internal side 3 of the screen 2 has a patterned luminescent layer which, as is known, generates a picture upon electron impact. A cone 4 of the bulb 1 forms the funnel-shaped junction between the screen 2 and the tube neck 5. The tube neck 5 ends in a socket 6. The beam system 7 includes multiple cathodes and further electrodes for generating and controlling the electrons.

By means of a mask frame not depicted in the Figure, a shadow mask 8 is arranged at the interior side 3 of the screen 2.

High voltage (25–30 kV operating voltage) is supplied through an anode contact 9.

Figure 2:
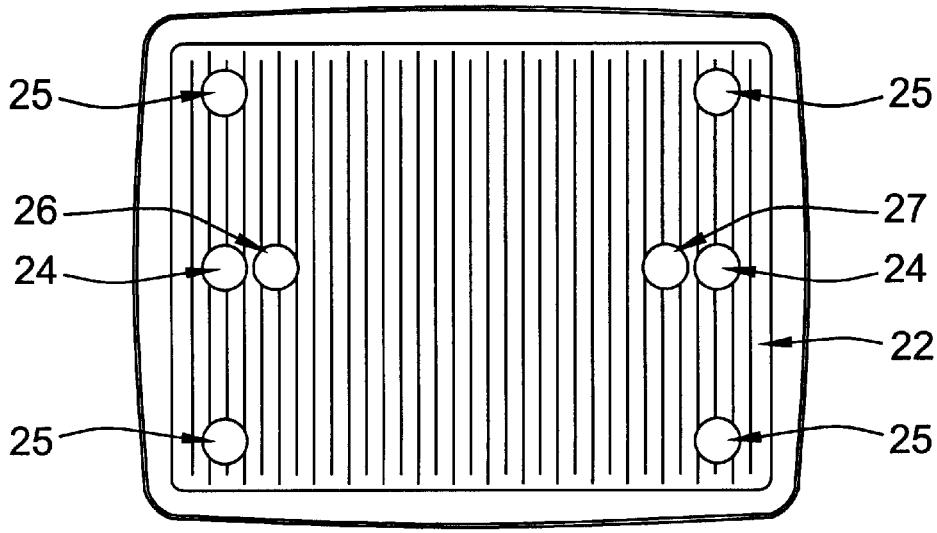
FIG. 2 shows a shadow mask in top view.

FIG. 2 shows a part of the shadow mask 8 in top view, herein designated as perforated mask 22. The thickness of the perforated mask 22 generally ranges from 0.130 to 0.280 mm within a narrow tolerance. The desired aperture patterns ar etched by chemical means.

Forming the shadow mask 8, which is required for tube function, is effected using deep drawing.

To assess the tubes under electron beam bombardment during operation, the impact behavior of the electrons is examined. To this end, the most biased areas of the perforated mask 22, represented by the four measuring points 25 and the measuring points 24, 26 and 27 are used. The beam impact drift caused by heating of the mask under electron beam bombardment is a gauge for tube quality and ultimately, a gauge for the success of any measures to avoid doming in the picture tubes.

Figure 3:
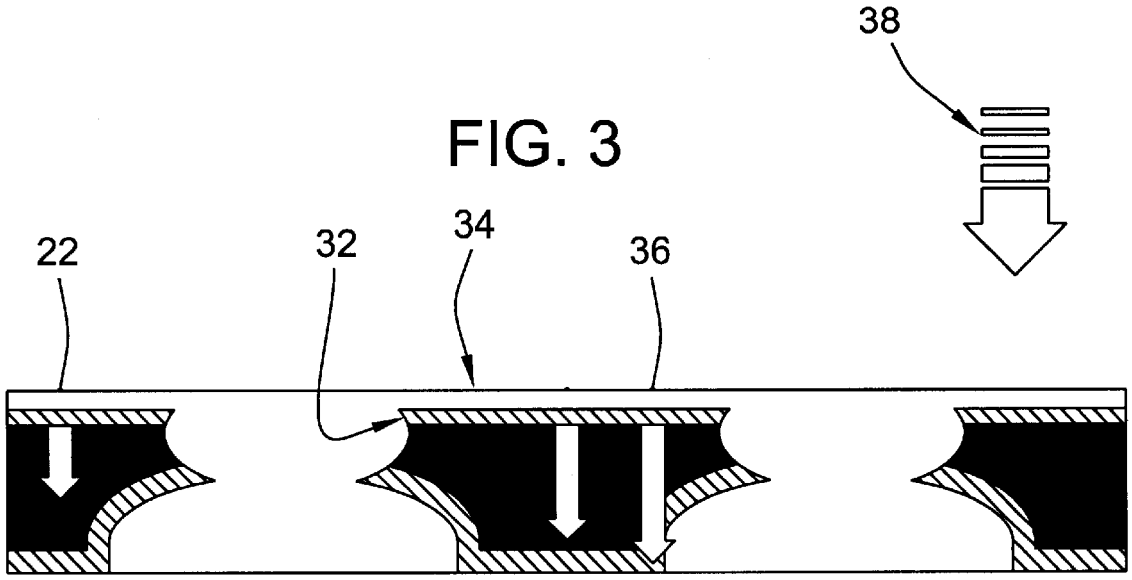
FIG. 3 shows a shadow mask in sectional view.
Figure 4:
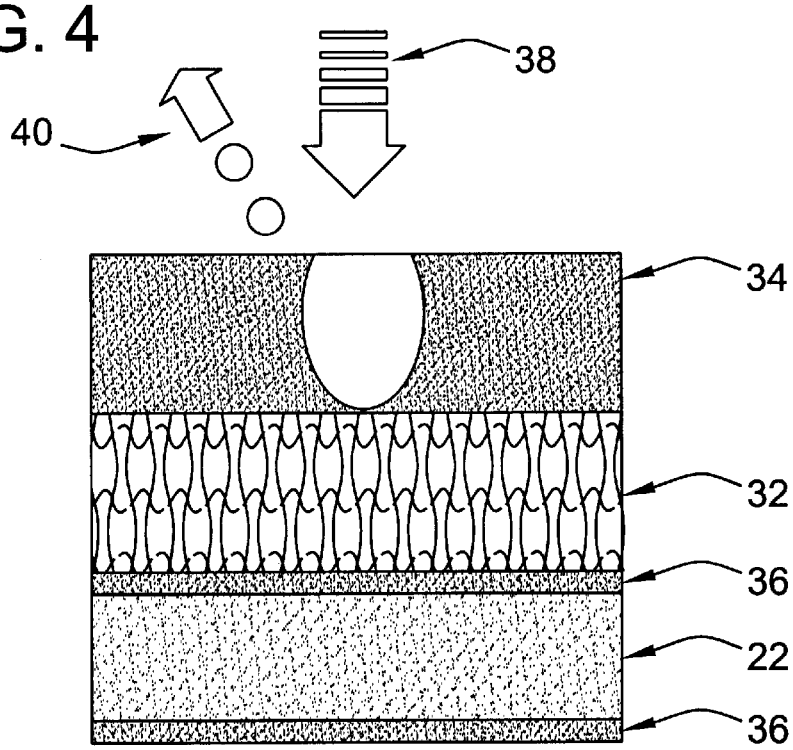
FIG. 4 shows a sectional view of a layer arrangement according to the invention.

The configuration of perforated mask 22 is shown in FIGS. 3 and 4. The perforated mask 22 provided with etched apertures 33 and has a $Fe_3O_4$ blackening layer 36. At the cathode side, the layer is coated with a heat-insulating layer 32.

The heat-insulating layer 32 is covered with a cover layer 34 of heavy metal chalcogenides. Due to the design of shadow mask 8 only part of the electrons pass through the perforated mask 22 and reach the luminescent layer. The major part 38 of the electrons strike the perforated mask 22. Due to the heavy metal atoms present in the cover layer 34, a smaller part 40 of the electrons is reflected (about 30%), and the others lose their energy in the cover layer, thereby heating the cover layer. The heat-insulating layer 32 prevents heat from being transferred to the steel perforated mask 22, and the heat is emitted to the rear side, i.e., in direction of beam system 7.

The main component of cover layer 34 is a heavy metal chalcogenide having a grain size below 1 $\mu$m. The chalcogenide grains are fixed to the underlying heat-insulating layer 32 by means of conventional binders.

According to the invention, the heat-insulating layer 32 consists of porous solids, with the porous material in this case consisting substantially of synthetic zeolite $M_{2/n}O.Al_2O_3.xSiO_2.yH_2O$, which is an aluminum silicate containing alkali (M=metal ion). For example, zeolites of structural type A have a module value x=2 and thus contain 2 parts $SiO_2$ to 1 part $Al_2O_3$. In zeolite 4A, the pore size is 0.4 nm and the pore volume is about 23%.

A zeolite sold by the Degussa Company under the trade name of WESSALITH P was used with success. The grain size of the zeolite powder was between 0.5 and 9 $\mu$m at an average particle size $D_{50}$ of 3.5 $\mu$m. The particle size was further decreased by milling.

The porous solids were fixed to the backing using water glass. By using water glass as a binder, good adherence of the heat-insulating layer 32 to the cover layer 34 can be achieved, and by using additives, such as surfactants and water, the required wetting behavior of the suspension can be adjusted prior to coating.

A spraying procedure proved to be a useful method both for coating the heat-insulating layer 32 and for coating the cover layer 34.

Measurements of the operational life of picture tubes produced according to the invention showed comparable behavior to picture tubes without A/D layers. A comparison in purity drift of tubes with an uncoated iron mask and tubes subjected to coating according to the invention resulted in a substantially reduced purity drift for the coated masks. Thus, the purity drift was reduced to 50% of the value of non-coated masks. This is also a significant improvement over the purity drift of masks coated with $B_2O_3$ only (30%).

In the measurements, areas of 10×10 $cm^2$ were scanned with an electron beam at 270 $\mu$A and 24 kV in the critical regions of the tube; the rest of the screen was not excited with electrons.

Embodiment 1

A perforated mask consisting predominantly of iron and provided on both sides with a $Fe_3O_4$ blackening layer is coated on the cathode side with a heat-insulating layer and a cover layer, using two successive spraying procedures.

The first heat-insulating layer located directly on the mask and 20 μm in thickness, is produced by spraying a dispersion consisting of 20 parts of zeolite 4A, $Na_{12}[(AlO_2)_{12}(SiO_2)_{12}].12H_2O$ (average particle size 2 μm), 5 parts of sodium silicate solution (5.8 M; Na/Si=0.61:0.1), 30 parts of water and 0.001 parts of a surfactant.

After drying the heat-insulating layer in a stream of hot air, the cover layer having a thickness of 3 μm is produced by spraying onto the heat-insulating layer a dispersion consisting of 20 parts of bismuth oxide, $Bi_2O_3$ (average particle size 0.9 μm), 10 parts of sodium silicate solution (5.8 M; Na/Si=0.61:1.0), 75 parts of water, and 0.001 parts of a surfactant.

After spray-coating the cover layer, the mask is baked at a temperature of 300° C.

Embodiment 2

As in embodiment 1, except that the heat-insulating layer is produced by spraying a dispersion of 20 parts of mesoporous zirconium dioxide, $ZrO_2$ (average particle size 2.5 μm), 4 parts of zirconium tetrapropylate, $(C_3H_7O)_4Zr$, 4 parts of tetraethoxysilane, $(C_2H_5O)_4Si$, pre-hydrolyzed with alkali, 20 parts of propanol, $C_3H_7OH$, and 0.2 parts of water.

Embodiment 3

As in embodiment 1, except that the heat-insulating layer is produced by spraying a dispersion of 20 parts of microporous α-zirconium dihydrogen phosphate, α-zr $(HPO_4)_2$, pillared thermally stable with aluminum oxide, $Al_2O_3$, and chromium oxide, $Cr_2O_3$, 2 parts of 80% phosphoric acid, $H_3PO_4$, and 40 parts of water.

What is claimed is:

1. A shadow mask for a color picture tube comprising a perforated mask containing iron and having on a cathode-side surface at least one porous heat-insulating layer including thermally stable porous particles and a binder, and at least one heavy metal-containing cover layer containing a binder, with the heat-insulating layer located between the perforated mask and the cover layer.

2. The shadow mask according to claim 1, wherein the porous particles are selected from the group consisting of particles of oxides, silicon compounds, phosphates, and mixtures of them.

3. The shadow mask according to claim 2, wherein the porous particles are metal oxides selected from the group consisting of titanium dioxide, zirconium dioxide, silicon dioxide, magnesium oxide, and aluminum oxide.

4. The shadow mask according to claim 2, wherein the porous particles are silicon compounds selected from the group consisting of zeolites, pillared clays, and silica gel.

5. The shadow mask according to claim 2, wherein the porous particles are phosphates selected from the group consisting of silicoaluminophosphates, metal aluminophosphates, and zirconium phosphate.

6. The shadow mask according to claim 1, wherein the heavy metal-containing cover layer comprises heavy metal chalcogenides selected from the group consisting of oxides and sulfides.

7. The shadow mask according to claim 6, wherein the heavy metal chalcogenides include black chalcogenides of heavy metals.

8. The shadow mask according to claim 7, wherein the heavy metal chalcogenides include black and non-black heavy metal chalcogenides in combination.

* * * * *